US010021988B2

(12) United States Patent
Samuels et al.

(10) Patent No.: US 10,021,988 B2
(45) Date of Patent: Jul. 17, 2018

(54) ACTIVELY VENTILATED CHAIR

(71) Applicant: Practechal Innovations LLC, El Cajon, CA (US)

(72) Inventors: Chris Samuels, El Cajon, CA (US); David Shamoon, El Cajon, CA (US); Jacob Marlay, Jamul, CA (US)

(73) Assignee: Practechal Innovations LLC, El Cajon, CA (US)

( * ) Notice: Subject to any disclaimer, the term of this patent is extended or adjusted under 35 U.S.C. 154(b) by 0 days.

(21) Appl. No.: 15/062,623

(22) Filed: Mar. 7, 2016

(65) Prior Publication Data

US 2017/0251814 A1 Sep. 7, 2017

(51) Int. Cl.
*A47C 7/74* (2006.01)

(52) U.S. Cl.
CPC ..... *A47C 7/744* (2013.01)

(58) Field of Classification Search
CPC .. B60N 2/5621; B60N 2/5628; B60N 2/5635; B60N 2/5642; B60N 2/565; B60N 2/5657; A47C 7/744
See application file for complete search history.

(56) References Cited

U.S. PATENT DOCUMENTS

| | | | | |
|---|---|---|---|---|
| 6,619,737 | B2 * | 9/2003 | Kunkel | B60N 2/5635 297/180.12 |
| 7,533,941 | B2 * | 5/2009 | Saitou | B60N 2/5621 297/452.27 |
| 7,665,803 | B2 * | 2/2010 | Wolas | A47C 7/744 297/180.1 |
| 9,211,811 | B2 * | 12/2015 | Breed | B60C 11/24 |
| 2004/0090093 | A1 * | 5/2004 | Kamiya | B60N 2/5657 297/180.14 |
| 2006/0175877 | A1 * | 8/2006 | Alionte | A47C 7/74 297/180.14 |
| 2011/0115635 | A1 * | 5/2011 | Petrovski | A47C 21/044 340/584 |
| 2014/0346820 | A1 * | 11/2014 | Brandt | B60N 2/5621 297/180.13 |
| 2015/0069811 | A1 * | 3/2015 | Sachs | B60N 2/5657 297/423.1 |
| 2016/0029805 | A1 * | 2/2016 | Arens | A47C 7/748 297/180.12 |

* cited by examiner

*Primary Examiner* — Philip F Gabler
(74) *Attorney, Agent, or Firm* — Sheppard, Mullin, Richter and Hampton, LLP; Jesse Salen; Mike Kim

(57) ABSTRACT

An actively ventilated chair includes a first distribution layer, a second distribution layer, and a fan, wherein the first distribution layer includes a large aperture on a first side and a plurality of small apertures on the second side, the second distribution layer couples to second side first distribution layer, and the fan couples to the first side of the first distribution layer such that it covers the large aperture, enabling the fan to direct air through the large aperture, into the first distribution layer, through the plurality of small apertures, and through the second distribution layer.

12 Claims, 11 Drawing Sheets

ACTIVELY VENTILATED CHAIR

TECHNICAL FIELD

The present disclosure relates generally to furniture and more specifically to an actively ventilated chair.

BACKGROUND

Climate-controlled air in living or working space may be provided to selective offices or entire buildings. Although an entire room may be cooled or heated as a unit, some users may have more selective temperature preferences, and thus, cooling or heating of entire work space or rooms may not be desirable. Offices generally have various pieces of furniture to facilitate working and comfort of employees. Generally, office furniture may include chairs. The surface temperatures for materials used in those chairs may generally track the ambient temperatures in the working spaces in which those chairs are located. In many situations, the surface temperatures of those materials may be increased by ambient body heat from users sitting in those chairs. For example, continuous contact between the users back and the backrest insulates heat which may lead to increased body temperature, perspiration, and discomfort. Additionally, many users may have selective temperature preferences so it may often be desirable to provide a personalized climate-controlled chair component so that instantaneous cooling may be achieved. Further, many users may desire a system that monitors their occupancy, vital signs, or ambient environment and adjusts to maintain their specified temperature preference.

BRIEF SUMMARY OF THE DISCLOSURE

The present disclosure is directed towards an actively ventilated chair. In particular, embodiments disclosed herein are directed toward an apparatus for cooling a chair.

An embodiment of the disclosure provides a chair component that includes multiple distribution layers which allow the air from a fan to uniformly flow through the apertures of the layers toward a user's body.

Another embodiment of the disclosure provides a monitoring module electronically coupled to the chair component, wherein the monitoring module includes sensors configured to monitor and transmit the users vital signs, ambient environment, or other user input to a computer processor configured to calculate a value and transmit the value to a control unit which determines whether to activate the fan to maintain a specified or calculated temperature.

Other features and aspects of the disclosure will become apparent from the following detailed description, taken in conjunction with the accompanying drawings, which illustrate, by way of example, the features in accordance with embodiments of the disclosure. The summary is not intended to limit the scope of the disclosure, which is defined solely by the claims attached hereto.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments of the disclosure.

The figures are not intended to be exhaustive or to limit the disclosure to the precise form disclosed. It should be understood that the disclosure may be practiced with modification and alteration, and that the disclosure may be limited only by the claims and the equivalents thereof.

DETAILED DESCRIPTION

Embodiments of the present disclosure are directed toward a climate-controlled chair component and a system for maintaining the cooling of an occupant while seated in an office chair.

Figure 1:
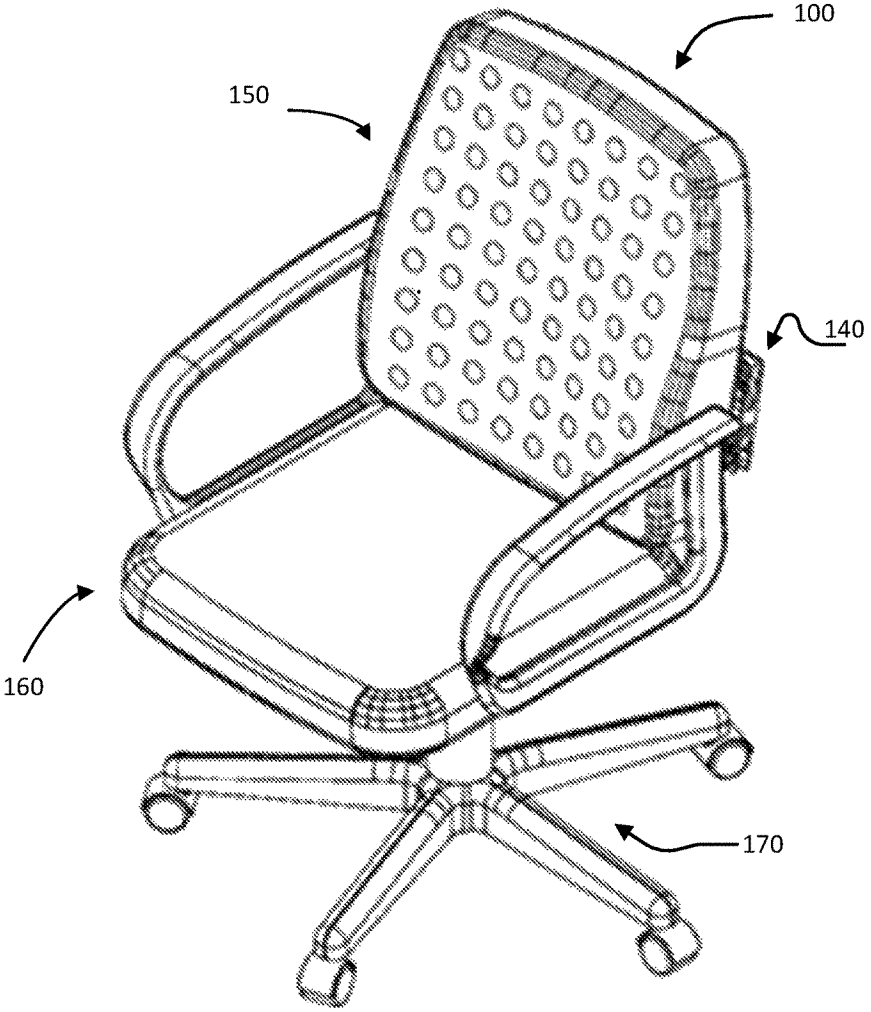
FIG. 1 illustrates a perspective view of a chair component used as both a seat and backrest for an office chair, consistent with embodiments disclosed herein.

As illustrated in the embodiment of FIG. 1, a chair assembly 100 may include a backrest portion 150 and a bottom seat portion 160. In some embodiments, the chair assembly 100 may also include a bottom base 170, which may enable an occupant to easily move the chair assembly 100 relative to a floor or another bottom surface through use of one or more bottom wheel assemblies. In other embodiments, the chair assembly 100 may be configured to swivel or rotate about a central axis. The chair assembly 100 may also include one or more other features, such as, for example, armrests, footrests, neck-rests, to further enhance the appearance and/or functionality of the chair assembly 100. In some embodiments, the chair assembly 100 includes one or more adjustment controls (e.g., knobs, levers, switches, etc.) that permit the position, tension, support and other characteristics of the various chair assembly components (e.g., backrest portion, bottom seat portion, armrests, footrests, etc.) to be adjusted, as desired or required by a particular user or application.

Figure 2:
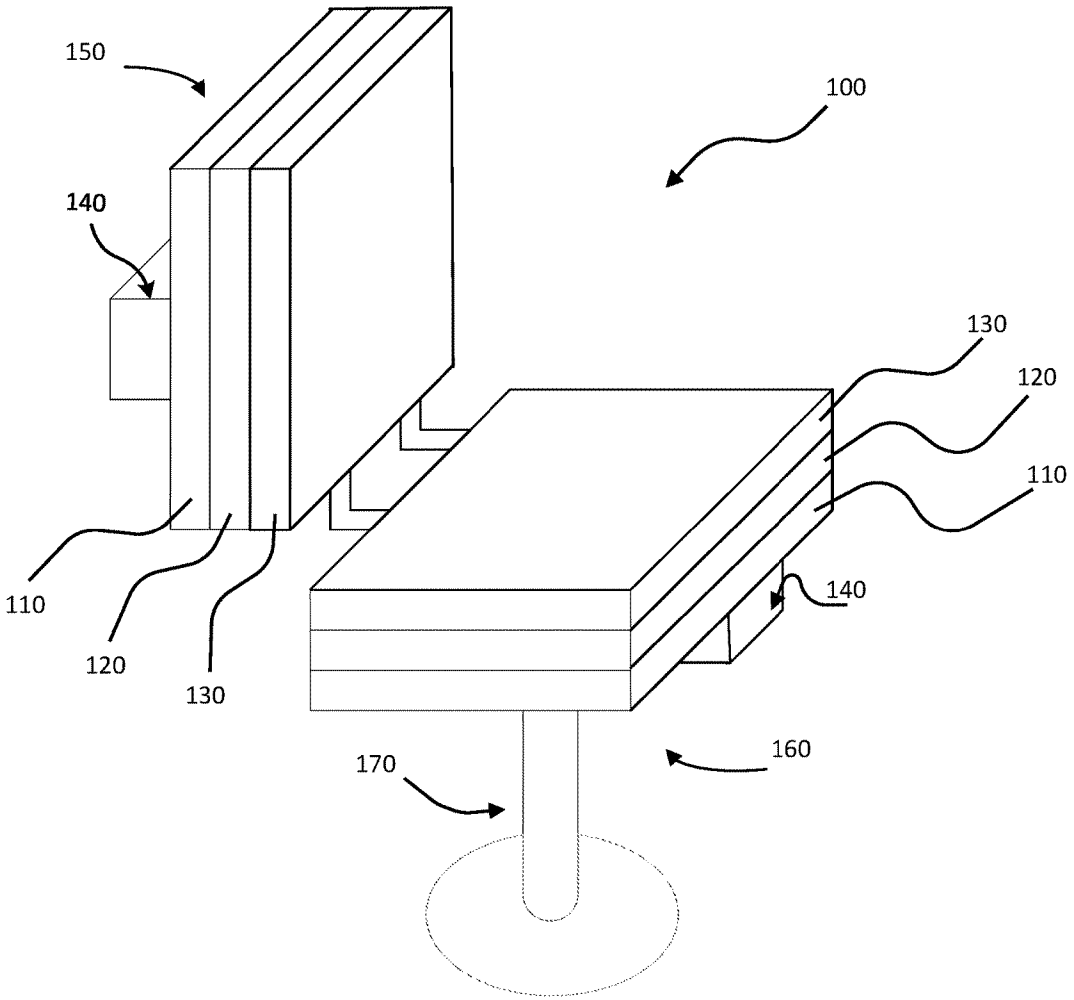
FIG. 2 illustrates a perspective view of a chair component indicating the placement of distribution layers, consistent with embodiments disclosed herein.

As illustrated in the embodiment of FIG. 2, a chair component may be used as the backrest portion 150 and/or the bottom seat portion. In some embodiments, a chair component may include a first distribution layer 110 and second distribution layer 130 coupled to an intermediate distribution layer 120. In other embodiments a chair component may include a first distribution layer 110 and second distribution layer 130 coupled together. In such embodiments the first distribution layer 110 may include a fan 140.

In further embodiments, the chair assembly 100 includes one or more climate control systems, the operational settings of which may be controlled using a control unit. The control unit may be situated so that it is easily accessible to an occupant while he or she is positioned within or near the chair assembly 100. In other embodiments, the control unit is remote and receives input from the occupants physical commands or from various sensors that acquire information from the occupant. Further, the control unit may be situated in one or more other locations than described herein.

Consistent with embodiments disclosed herein, an occupant may contact both the backrest portion 150 and the bottom seat portion 160 during use. In some embodiments, the backrest portion 150 may be positioned (e.g., horizontal, reclined) such that both the backrest portion 150 and/or the bottom seat portion 160 are used to support the occupant.

Figure 3:
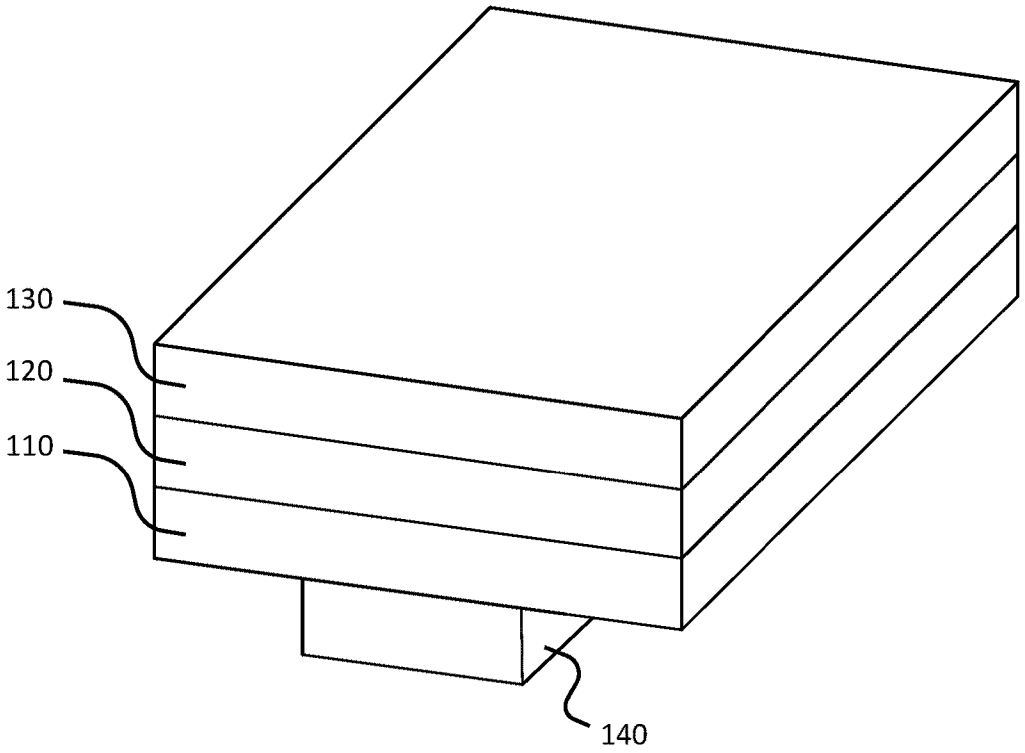
FIG. 3 illustrates a perspective view of a chair component, consistent with embodiments disclosed herein.
Figure 4:
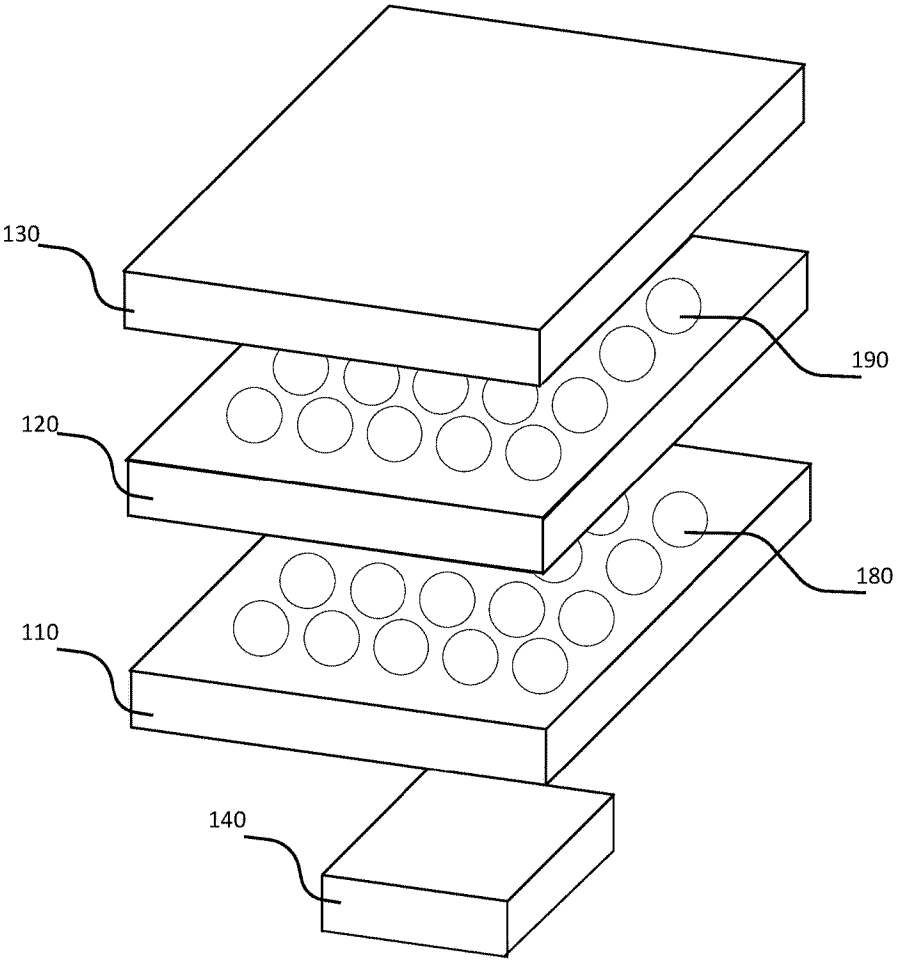
FIG. 4 illustrates an exploded front view of a chair component, consistent with embodiments disclosed herein.

FIG. 3 illustrates a perspective view of one embodiment of the chair component. FIG. 4 illustrates an exploded front view of one embodiment of the chair component.

Figure 5:
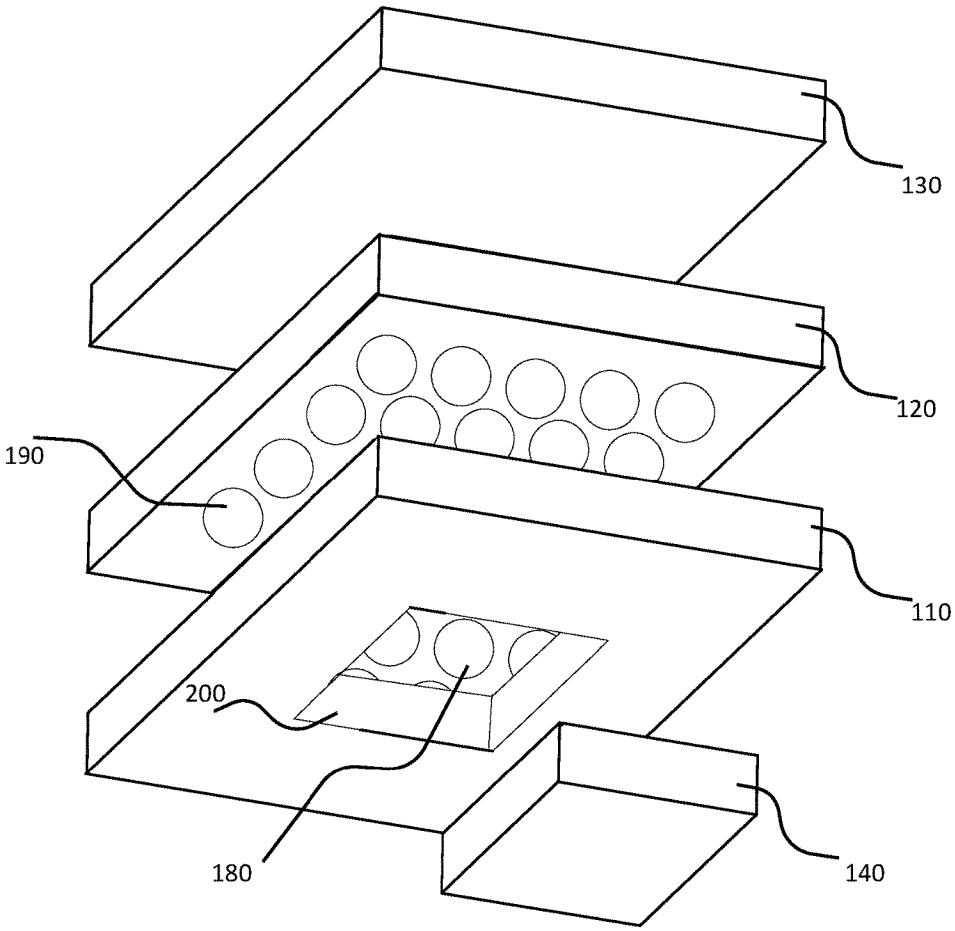
FIG. 5 illustrates an exploded rear view of a chair component, consistent with embodiments disclosed herein.

As illustrated in FIG. 5, the chair component may include a first distribution layer 110 comprising a first side shaped to form a large aperture 200 and a second side shaped to form a plurality of small apertures 180, as illustrated in FIG. 4. In such embodiment, the first distribution layer 110 comprises at least two side walls adjoining opposite edges of the first side to the opposite edges of the second side to form an enclosure. In some embodiments, the second distribution layer 130 couples directly to the first distribution layer 110. In other embodiments, an intermediate distribution layer is situated between the first distribution layer 110 and second distribution layer 130. In such embodiments, the intermediate distribution layer 120 is shaped to form channels 190 matching the shape of the plurality of small apertures 180 of the second side of the first distribution layer. It will be appreciated that the number, size, spacing, quantity, location and/or other details of the apertures 180 and 200 may be different than discussed and/or illustrated herein, as desired by a user or as required by a particular application or use. In such embodiments, the fan 140 is positioned such that the fan 140 directs air through the large aperture 200, into the first distribution layer 110, through the plurality of small apertures 180, and into the second distribution layer 130 when the fan is powered on.

In other embodiments, as illustrated in FIG. 5, the intermediate distribution layer 120 allows air created by the fan to flow through the first distribution layer 110 through the channels 190 of the intermediate distribution layer 120 into the second distribution layer 130 and out toward the seated occupant. Alternatively, the fan 140 may be configured to generate a suction force, thereby drawing air away from the occupant. Although the illustrated backrest portion 150 and bottom seat portion 160 include only a single fan 140, it will be appreciated that additional fans may be provided in order to deliver or suction the desired or required air volume to or away from the chair assembly 100. Further, the fan 140 may be an axial or radial fan configured using brushless fan blades. In other embodiments, the distribution layers and fan may be provided in any other part of the chair assembly 100 to direct air toward the occupant (e.g., armrests, footrest, neck rest).

In yet another embodiment of the apparatus, the fan 140 may include a cover such that the fan 140 is placed between the cover and the first distribution layer 110. In such embodiment, the cover may extend across any area of the first distribution layer 110. In other embodiments, the cover may extend beyond the area of first distribution layer. In one embodiment, the cover may couple directly to the first distribution layer 110 such that the fan 140 is placed between the cover and the first distribution layer 110. In such embodiment, the fan 140 may directly couple to the cover and/or the first distribution layer 110. In other embodiments, the fan may indirectly couple to the cover and/or first distribution layer 110. Further, the fan may be integrated within the cover such that the cover and the fan 140 are coupled to create one unified layer. In such embodiment, this one unified layer may couple directly to the first distribution layer 110.

Figure 6:
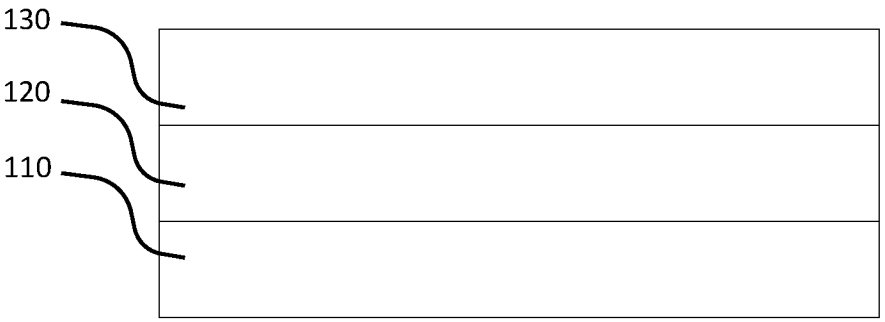
FIG. 6 illustrates a side view of a chair component, consistent with embodiments disclosed herein.
Figure 7:
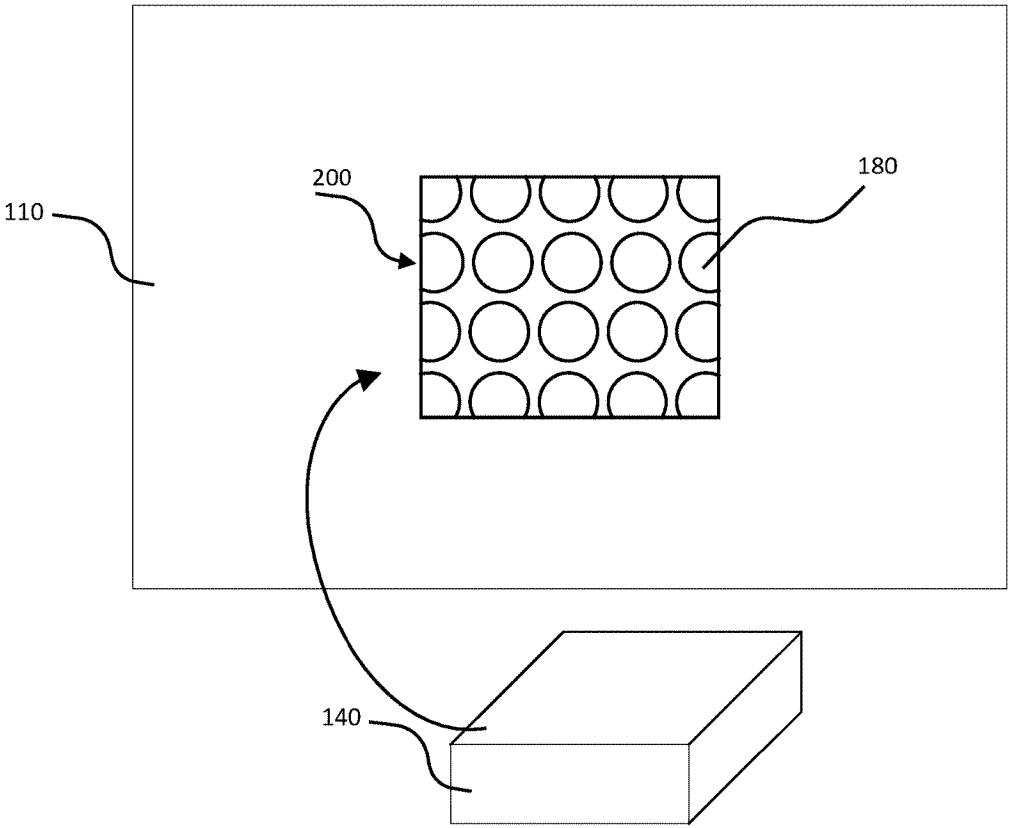
FIG. 7 illustrates a rear view of the first distribution layer, consistent with embodiments disclosed herein.
Figure 8:
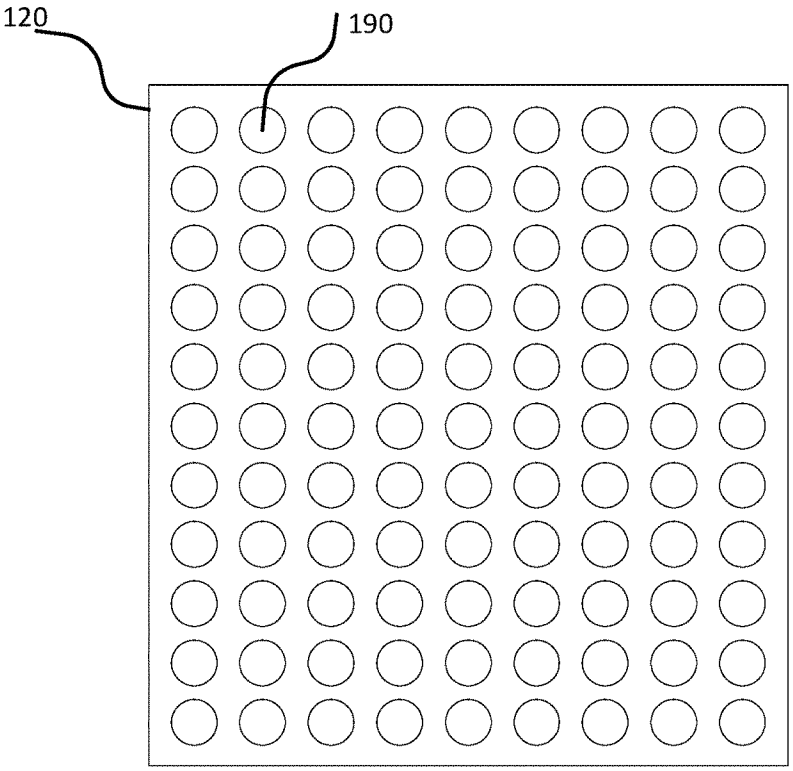
FIG. 8 illustrates a rear view of the intermediate distribution layer thereof and a mirror image of the front view, consistent with embodiments disclosed herein.

FIG. 6 illustrates a side view of one embodiment of the chair component. FIG. 7 illustrates a rear view of one embodiment of the first distribution layer. FIG. 8 illustrates a rear view of one embodiment of the intermediate distribution layer thereof and a mirror image of the front view.

With continued reference to the distribution layers, the composition of such layers may include a variety of materials. The first distribution layer 110 may be made using materials such that the layer also acts as a frame that preferably provides the chair component with the necessary structural strength, integrity and durability. In one embodiment, the first distribution layer 110 may be made of wood, steel, plastic, aluminum, rubber, and/or synthetic or natural fabric. The second distribution layer 130 may be made using materials such that the layer allows the air to flow through toward or away from the occupant. In one embodiment, the second distribution layer 130 may be made of 3-dimensional mesh, foam, rubber, plastic, cloth, and/or synthetic or natural fabric. The intermediate distribution layer 120 may be made using materials such that the layer allows the air from the first distribution layer 110 to flow through the channels 190 into the second distribution layer 130. In one embodiment, the intermediate distribution layer 120 may be made of 3-dimensional mesh, foam, rubber, plastic, cloth, and/or synthetic or natural fabric. For example, a 3-dimensional mesh may be a fabric mesh constructed with multiple fabric strands, bundles, or connectors that intersect in three different dimensions as to form channels, gaps, or interstitial spaces that enable the flow of air between the fabric strands, bundles, or connectors. The fabric strands, bundles, or connectors may form cubic shapes (i.e., with six sides), pyramidal shapes, or other polymorphic shapes, so long as they allow for gaps between each side to enable air flow through the fabric. The gaps may be uniform or non-uniform throughout the mesh, and may range in size from microscopic gaps to macroscopic gaps on the order of microns, millimeters, or centimeters in size. Thus, a 3-dimensional mesh includes a plurality of channels passing through the interstitial spaces set up between fabric strands, bundles, or connectors.

In other embodiments, the chair component and/or any one or more of the distribution layers may be fully or partially encapsulated in synthetic or natural fabric. It will be appreciated that the type of material may be different than discussed and/or illustrated herein, as desired by a user or as required by a particular application or use.

In further embodiments, the chair component may be advantageously equipped and otherwise configured with a controller that permits an occupant to control the flow rate of the air delivered to the occupant. In such embodiments, the controller may be a switch, dial, or other adjustment device for regulating the air flow.

Figure 9:
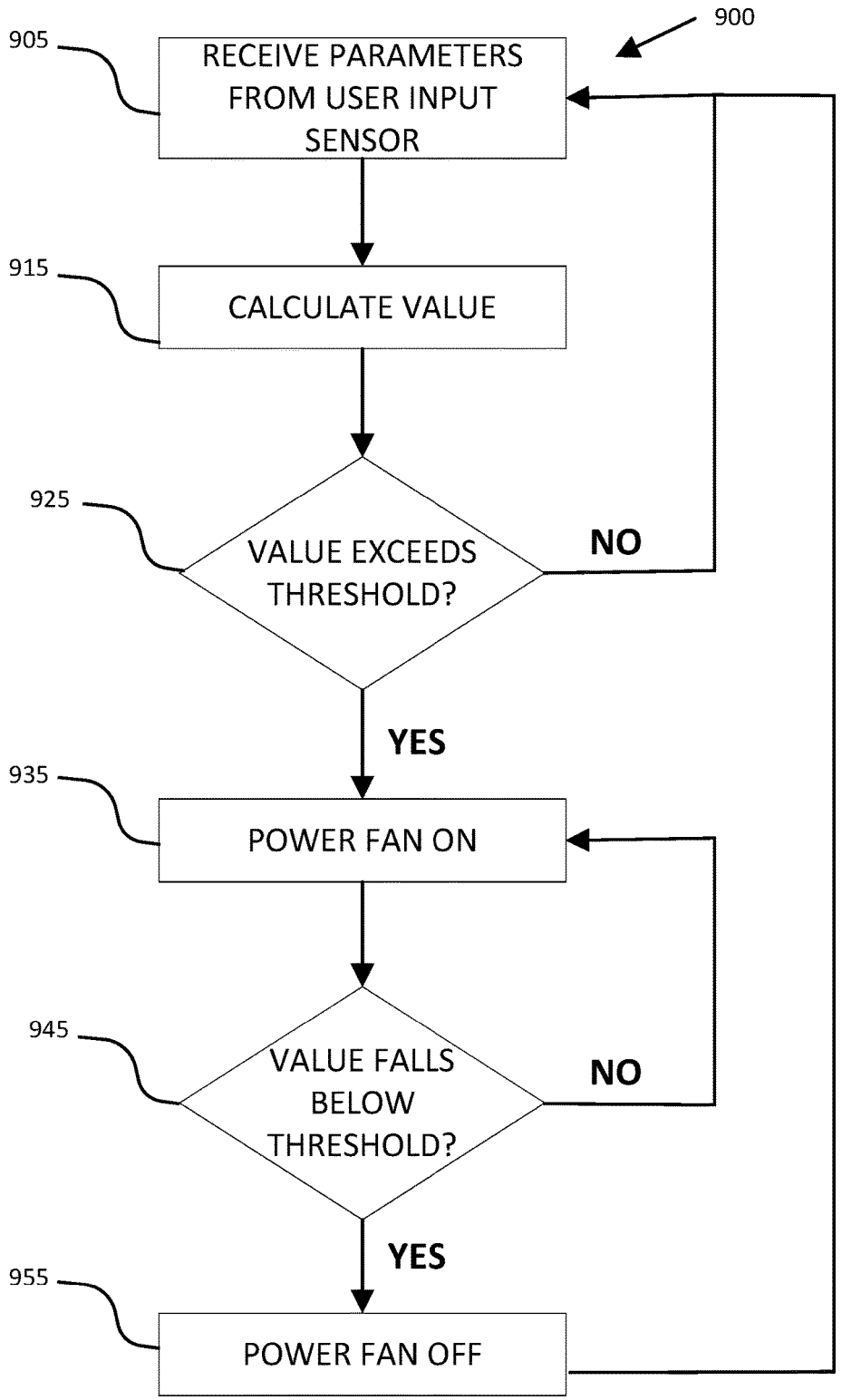
FIG. 9 is a flow diagram illustrating a system for controlling a fan consistent with embodiments disclosed herein.

FIG. 9 is a flow diagram illustrating how one embodiment of the chair assembly 100 may operate. The procedure includes a sensor receiving one or more parameters through a user input at step 905, calculating a value at step 915, and determining if the value exceeds the predetermined or specified threshold value at step 925. If the value exceeds the predetermined or specified threshold value at step 925, the fan 140 will activate at step 935. At step 945, the sensor will continue receiving one or more parameters through a user input to determine if the calculated value drops below the predetermined or specified threshold value. If the value drops below the predetermined or specified threshold value, the fan will turn off as illustrated in step 955.

Figure 10:
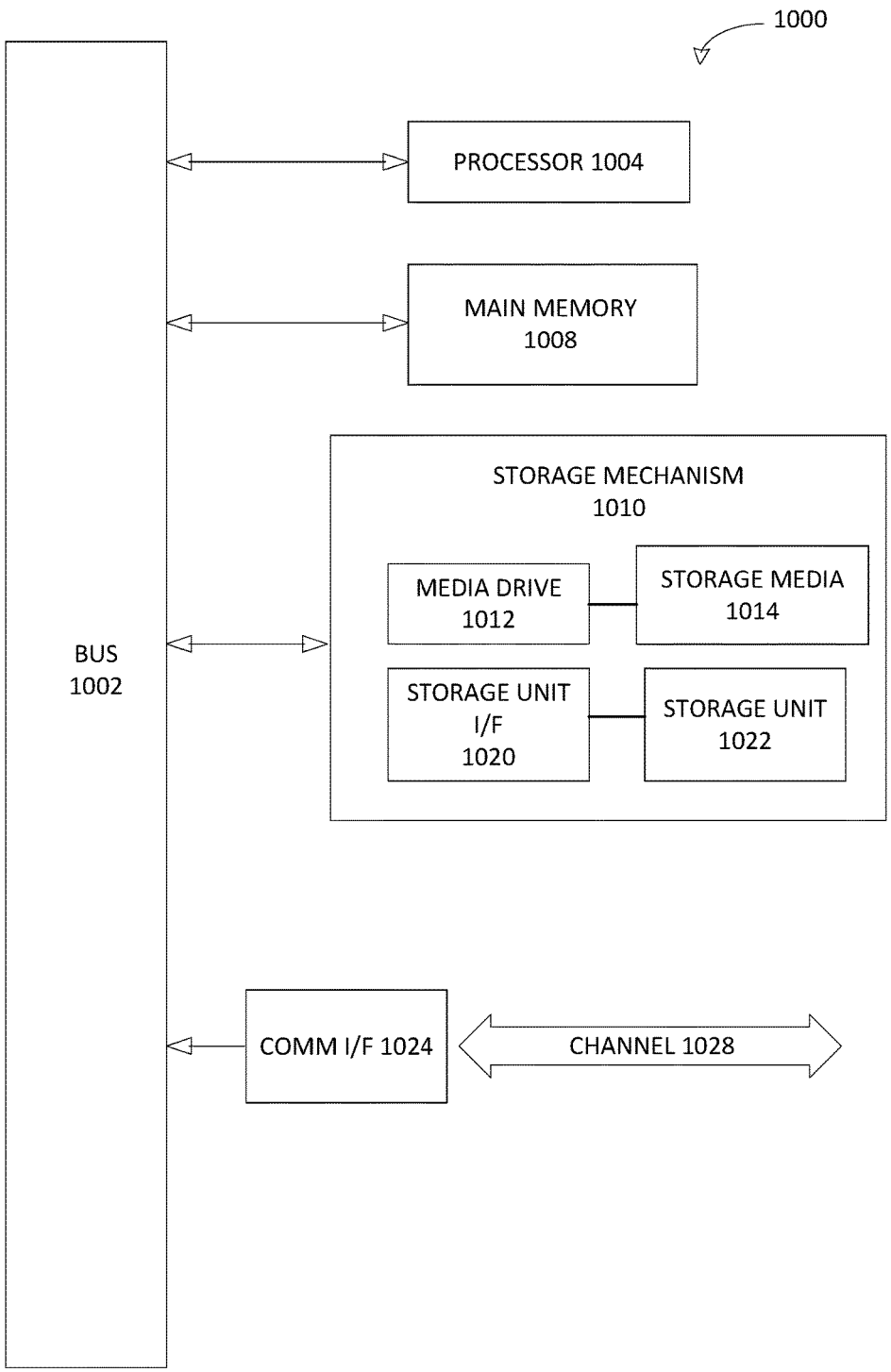
FIG. 10 is a block diagram illustrating the components of a system for controlling a fan consistent with embodiments disclosed herein.

Referring now to FIG. 10, computing module 1000 may represent, for example, computing or processing capabilities found within desktop, laptop, notebook, and tablet computers; hand-held computing devices (tablets, PDA's, smart phones, cell phones, palmtops, smart-watches, smart-glasses etc.); mainframes, supercomputers, workstations or servers; or any other type of special-purpose or general-purpose computing devices as may be desirable or appropriate for a given application or environment. Computing module 1000 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 1000 might include, for example, one or more processors, controllers, control modules, or other processing devices, such as a processor 1004. Processor 1004 might be implemented using a general-purpose or special-purpose processing engine such as, for example, a microprocessor, controller, or other control logic. In the illustrated example, processor 1004 is connected to a bus 1002, although any communication medium may be used to facilitate interaction with other components of computing module 1000 or to communicate externally.

Computing module 1000 might also include one or more memory modules, simply referred to herein as main memory 1008. For example, preferably random access memory (RAM) or other dynamic memory, might be used for storing information and instructions to be executed by processor 1004. Main memory 1008 might also be used for storing temporary variables or other intermediate information during execution of instructions to be executed by processor 1004. Computing module 1000 might likewise include a read only memory ("ROM") or other static storage device coupled to bus 1002 for storing static information and instructions for processor 1004.

The computing module 1000 might also include one or more various forms of information storage mechanism 1010, which might include, for example, a media drive 1012 and a storage unit interface 1020. The media drive 1012 might include a drive or other mechanism to support fixed or removable storage media 1014. For example, a hard disk drive, a solid state drive, a magnetic tape drive, an optical disk drive, a CD or DVD drive (R or RW), or other removable or fixed media drive might be provided. Accordingly, storage media 1014 might include, for example, a hard disk, a solid state drive, magnetic tape, cartridge, optical disk, a CD or DVD, or other fixed or removable medium that is read by, written to or accessed by media drive 1012. As these examples illustrate, the storage media 1014 may include a computer usable storage medium having stored therein computer software or data.

In alternative embodiments, information storage mechanism 1010 might include other similar instrumentalities for allowing computer programs or other instructions or data to be loaded into computing module 1000. Such instrumentalities might include, for example, a fixed or removable storage unit 1022 and a storage interface 1020. Examples of such storage units 1022 and storage interfaces 1020 may include a program cartridge and cartridge interface, a removable memory (for example, a flash memory or other removable memory module) and memory slot, a PCMCIA slot and card, and other fixed or removable storage units 1022 and storage interfaces 1020 that allow software and data to be transferred from the storage unit 1022 to computing module 1000.

Computing module 1000 might also include a communications interface 1024. Communications interface 1024 might be used to allow software and data to be transferred between computing module 1000 and external devices. Examples of communications interface 1024 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 1024 might typically be carried on signals, which may be electronic, electromagnetic (which includes optical) or other signals capable of being exchanged by a given communications interface 1024. These signals might be provided to communications interface 1024 via a channel 1028. This channel 1028 might carry signals and might be implemented using a wired or wireless communication medium. Some examples of a channel might include a phone line, a cellular link, an RF link, an optical link, a network interface, a local or wide area network, and other wired or wireless communications channels.

Figure 11:
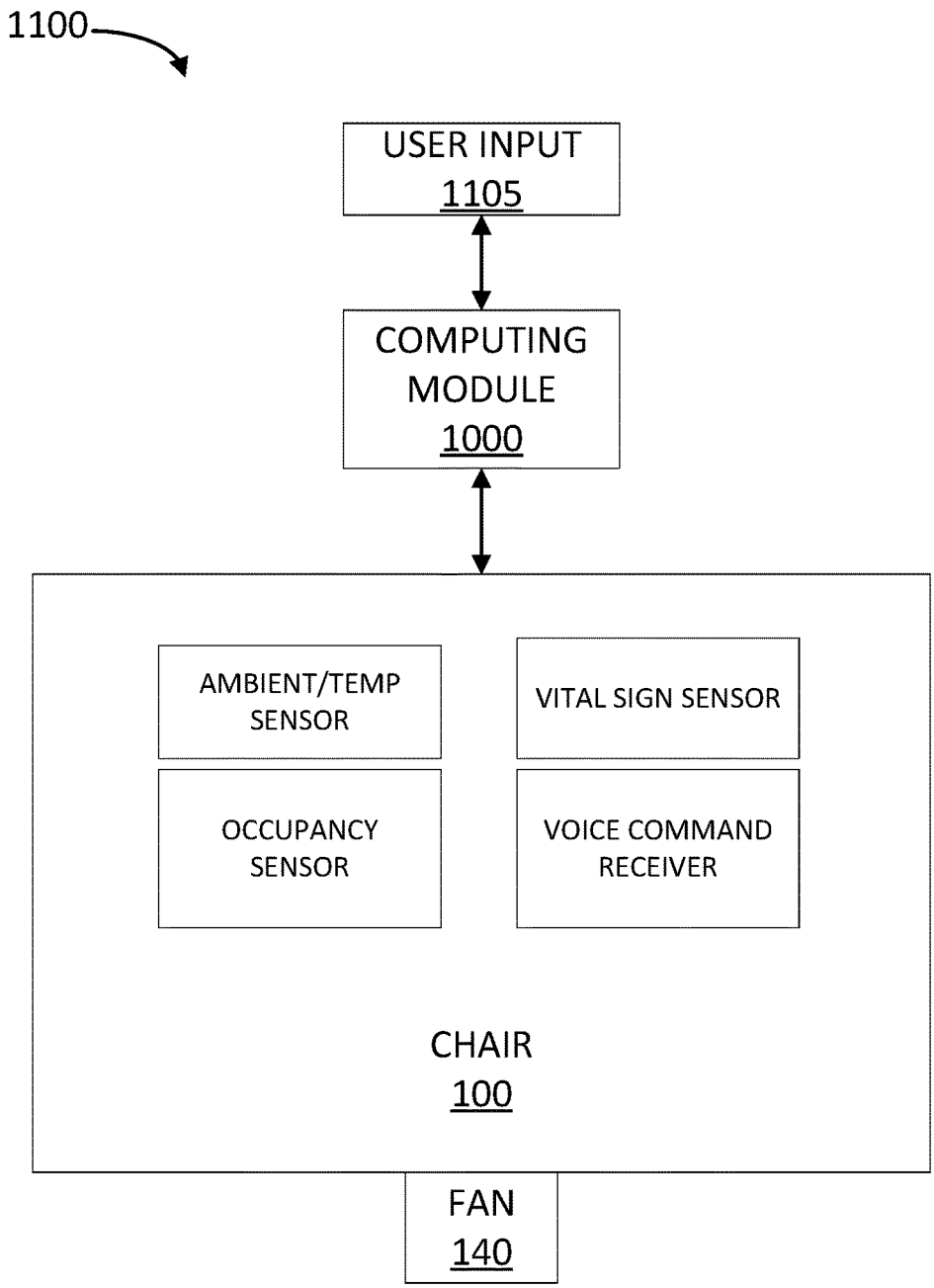
FIG. 11 is a block diagram illustrating input devices configured to operate a fan consistent with embodiments disclosed herein.

FIG. 11 is a diagram illustrating one embodiment of the chair assembly 100 including various input devices configured to operate the fan 140 as a function of user input and/or system determinable parameters. The fan 140 may operate for a given time interval, as a trend over several intervals, or until a specific parameter is met. In some embodiments, the user input of 1105 may be received by one or more biosensors, occupancy sensors, voice recognition receivers, wireless receivers, or user switches and transmitted to the computing module 1000 as illustrated in FIG. 10.

In one embodiment, the chair assembly 100 is provided with an occupancy sensor for detecting that a user is seated on the chair assembly 100. In such embodiment, when a pressure higher than a predetermined level is applied to the chair assembly 100, the sensor may transmit a signal to the computing module 1000, which may in turn activate the fan. The fan may otherwise remain off. In some embodiments, the sensor may be a pressure sensor. In other embodiments, the sensor may be an optical sensor or thermodynamic sensor to detect seat occupancy. When an occupant sits on the chair assembly 100, the sensor sends a signal to the computing module, which may determine if a threshold level (i.e., as indicated by the signal) is reached, and if so, may enable the fan. When the user stands up from the chair assembly 100, the sensor may send a corresponding signal to the computing module to disable the fan.

For example, a chair-cooling system may include a chair component consistent with embodiments disclosed herein and a computing module computing module 1000. The chair component may also include a switch for activating the fan and an environmental sensor. The computing module computing module 1000 may include a computer processor and a non-transitory memory with software embedded thereon. The software may be configured to receive a signal from an environmental sensor and control the fan in response to the signal. For example, the signal may be transmitted from the environmental sensor via wireless signal, or via an electrical connection such as a wire. Thus, the environmental sensor may trigger a signal in response to changes in environmental conditions, such as temperature, pressure, light, or other environmental changes as would be known in the art.

In some examples, the environmental sensor is mechanically coupled to the chair component. The environmental sensor may be configured to detect an occupant sitting in the chair and the software may be configured to switch on the fan if an occupant is detected and switch off the fan if no occupant is detected.

In some examples, the sensor may be configured to detect a temperature or change in temperature and the software may be configured to switch on the fan when the temperature exceeds a predetermined threshold, and switch off the fan when the temperature falls below another predetermined threshold. The thresholds may be set via a user interface, for example, using an app on a smart phone or computing device.

In some examples, the sensor may be configured to detect a vital sign of an occupant and the software is configured to switch on the fan when the vital sign exceeds a predetermined threshold, and switch off the fan when the vital sign falls below another threshold. For example, the vital sign may be a heart rate, a repertory rate, a body temperature, a blood pressure, a blood oxygenation level, or other vital sign as known in the art.

In some examples, a sound sensor may be coupled to the chair component and configured to detect a voice command, and send a signal to the computing module in response to the voice command. The software may be configured to switch on or switch off the fan in response to the voice command.

The chair module may also include a wireless transceiver configured to receive a command from a remote device and send a signal to the computing module in response to receiving the command. The software may be configured to switch on or switch off the fan in response to the command. For example, the remote device may be a smart phone.

The computing module 1000 may further comprise a wireless transceiver. The computing module 1000 may be configured to process input signals from the user input devices, store the processed signals as data, and transmit the data using the wireless transceiver. The transceiver is configured to communicate using available wireless communications standards. For example, in some embodiments, the wireless transceiver may be a Bluetooth® transceiver, a Wi-Fi transceiver, a GPS transceiver, a cellular transceiver, or some combination thereof. In an alternative embodiment, the wireless transceiver may further comprise a wired interface (e.g. USB, fiber optic, HDMI, etc.) for communicating stored data.

In some embodiments, the computing module 1000 may further detect and store metrics such as the amount of time a user has remained seated without physical activity over a recent period of time and provide a user score. The user score in combination with other parameters could indicate the user's physical condition and aptitude for further physical activity that day. The user score may also be calculated on a scale of between 1 and 100, or any other scale or range.

It will be appreciated that the one or more electrically-powered components of the different embodiments of the chair component disclosed and illustrated herein (e.g., the fan, switches, sensors, computer, etc.) may be powered by any combination of AC, DC, battery or any other power source. In such embodiments, the climate controlled chair component may include a power cord which is configured to plug into an AC power outlet. In other embodiments, the climate controlled chair component includes a rechargeable battery, a disposable battery and/or some other power pack. In one embodiment, the rechargeable battery may be configured to be recharged using an AC power source (e.g., battery may be charged while components are not in use). In other embodiments, the chair component may be powered by one or more other power sources, such as, for example, wireless charging, solar panels, conversion of mechanical movement of the chair to electric power and/or the like.

In this document, the terms "computer program medium" and "computer usable medium" are used to generally refer to transitory or non-transitory media such as, for example, memory 1008, storage unit 1020, media 1014, and channel 1028. These and other various forms of computer program media or computer usable media may be involved in carrying one or more sequences of one or more instructions to a processing device for execution. Such instructions embodied on the medium are generally referred to as "computer program code" or a "computer program product" (which may be grouped in the form of computer programs or other groupings). When executed, such instructions might enable the computing module 1000 to perform features or functions of the present application as discussed herein.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

While various embodiments of the present disclosure have been described above, it should be understood that they have been presented by way of example only, and not of limitation. Likewise, the various diagrams may depict an example architectural or other configuration for the disclosure, which is done to aid in understanding the features and functionality that may be included in the disclosure. The disclosure is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present disclosure. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosure is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the disclosure, whether or not such embodiments are described and whether or not such features are presented as being a part of a described embodiment. Thus, the breadth and scope of the present disclosure should not be limited by any of the above-described exemplary embodiments.

What is claimed is:

1. A chair component comprising:

a first distribution layer, a second distribution layer, an intermediate distribution layer located between the first distribution layer and the second distribution layer, and a fan;

wherein the first distribution layer comprises a first side fabricated from a substantially rigid material and shaped to form a large aperture, a second side fabricated from the substantially rigid material and shaped to form a plurality of small apertures, and at least two side walls adjoining opposite edges of the first side to respective opposite edges of the second side to form an enclosure;

the second distribution layer comprises the substantially rigid material and couples to an outside surface of the second side of the first distribution layer, such that the first and the second distribution layers form a substantially rigid frame enclosing the intermediate distribution layer, wherein pressure on the substantially rigid frame does not deform the intermediate distribution layer;

the intermediate distribution layer comprises a 3-dimensional mesh to enable the flow of air through the 3-dimensional mesh;

the fan couples to an outside surface of the first side of the first distribution layer and covers the large aperture, such that the fan directs air through the large aperture, into the first distribution layer, through the plurality of small apertures, through the intermediate distribution layer, and into the second distribution layer when the fan is powered on; and an environmental sensor mechanically couples to the chair component, the environmental sensor being configured to detect a vital sign of an occupant so that the fan switches on when the vital sign exceeds a predetermined threshold.

2. The chair component of claim 1, wherein the chair component is a seat or a backrest.

3. The chair component of claim 1, wherein the first distribution layer comprises wood, steel, plastic, or aluminum.

4. The chair component of claim 1, wherein each small aperture is shaped to form a circle, oval, triangle, square, rectangle, rhombus, parallelogram, pentagon, or hexagon.

5. The chair component of claim 1, wherein the chair component is encapsulated in fabric.

6. The chair component of claim 1, wherein the intermediate distribution layer is shaped to form a plurality of channels, wherein each channel has a profile matching the shape of and aligned with a corresponding small aperture such that air directed from the fan flows freely through each of the large aperture, the first distribution layer, the corresponding small aperture, and the channel.

7. A chair-cooling system comprising;

a chair component, the chair component comprising:

a first distribution layer, a second distribution layer, an intermediate distribution layer located between the first distribution layer and the second distribution, and a fan;

wherein the first distribution layer comprises a first side fabricated from a substantially rigid material and shaped to form a large aperture, a second side fabricated from the substantially rigid material and shaped to form a plurality of small apertures, and at least two side walls adjoining opposite edges of the first side to respective opposite edges of the second side to form an enclosure;

the second distribution layer comprises the substantially rigid material and couples to an outside surface of the second side of the first distribution layer such that the first and second distribution layers form a substantially rigid frame enclosing the intermediate distribution layer, wherein pressure on the substantially rigid frame does not deform the intermediate distribution layer;

the intermediate distribution layer comprises a 3-dimensional mesh to enable the flow of air through the 3-dimensional mesh; and the fan couples to an outside surface of the first side of the first distribution layer and covers the large aperture, such that the fan directs air through the large aperture, into the first distribution layer, through the plurality of small apertures, through the intermediate distribution layer, and into the second distribution layer when the fan is powered on;

a switch for activating the fan; and a computer processor and a non-transitory memory with software embedded thereon, the software configured to receive a signal from an environmental sensor and control the fan in response to the signal;

wherein the environmental sensor is mechanically coupled to the chair component and configured to detect a vital sign of an occupant and the software is configured to switch on the fan when the vital sign exceeds a predetermined threshold.

8. The chair-cooling system of claim 7, wherein the environmental sensor is mechanically coupled to the chair component and configured to detect an occupant sitting in the chair and the software is configured to switch off the fan if no occupant is detected.

9. The chair-cooling system of claim 7, wherein the environmental sensor is mechanically coupled to the chair component and configured to detect a temperature and the software is configured to switch on the fan when the temperature exceeds a predetermined threshold.

10. The chair-cooling system of claim 7, wherein the environmental sensor is mechanically coupled to the chair component and configured to detect a voice command and the software is configured to switch on or switch off the fan in response to the voice command.

11. The chair-cooling system of claim 7, further comprising a transceiver configured to receive a command from a remote device and the software is configured to switch on or switch off the fan in response to the command.

12. The chair-cooling system of claim 7, wherein the remote device is a smart phone.

* * * * *